United States Patent [19]

Strub

[11] 4,154,032

[45] May 15, 1979

[54] STAIRS AND METHOD OF MAKING THE SAME

[76] Inventor: Robert D. Strub, 817 S. Capitol, Iowa City, Iowa 52240

[21] Appl. No.: 874,413

[22] Filed: Feb. 2, 1978

[51] Int. Cl.[2] ..... E04F 11/10

[52] U.S. Cl. ..... 52/188; 52/741

[58] Field of Search ..... 52/182, 183, 184, 188, 52/191, 741

[56] References Cited

U.S. PATENT DOCUMENTS

| | | | |
|---|---|---|---|
| 1,893,876 | 1/1933 | Anderson | 52/191 |
| 3,393,481 | 7/1968 | Meuret | 52/188 |

FOREIGN PATENT DOCUMENTS

| | | | |
|---|---|---|---|
| 613612 | 11/1926 | France | 52/182 |

*Primary Examiner*—John E. Murtagh

*Attorney, Agent, or Firm*—James C. Nemmers; Haven E. Simmons

[57] ABSTRACT

A construction for wooden stairs that provides for rapid layout and assembly of the stairs by using an interlocking technique that locks the treads and risers into the stringers without the use of fasteners, adhesives or wedges. The construction technique and the resulting unique stairs substantially reduces the layout and assembly time from that required by conventional stairs by accurately machining the required dovetail grooves in the stringers and the corresponding male dovetail on each tread and riser end. Each tread and riser are then slid into place in the stringers and are interlocked so that once the stairs are assembled and interlocked, it is impossible for the components to become separated.

9 Claims, 8 Drawing Figures

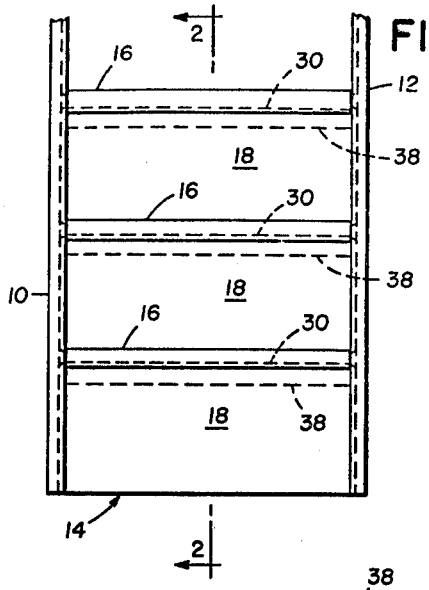
FIG 1
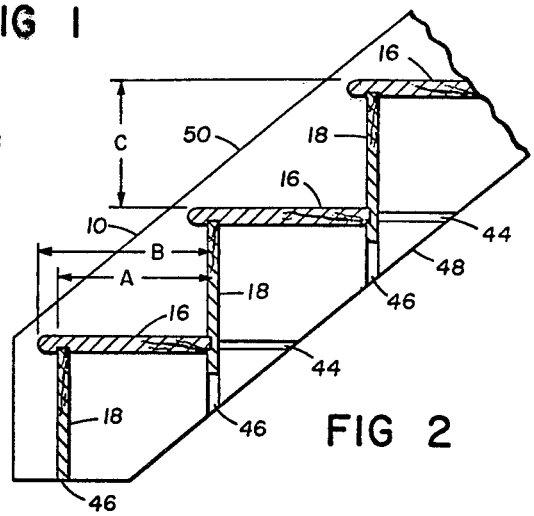
FIG 2
FIG 3
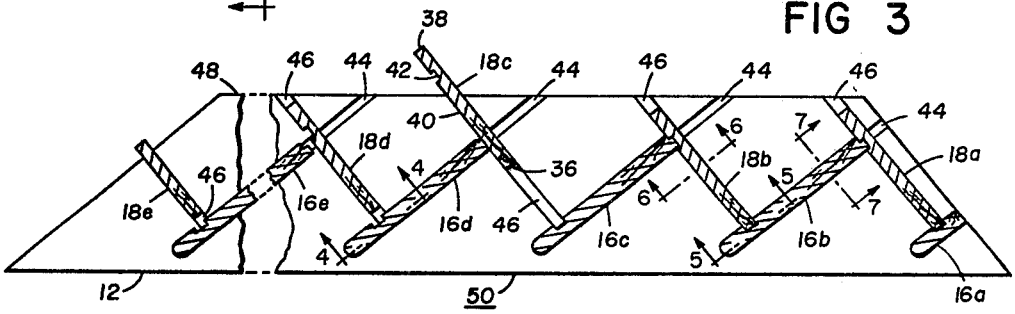
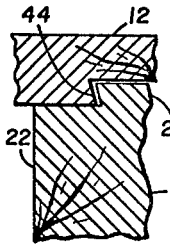
FIG 4
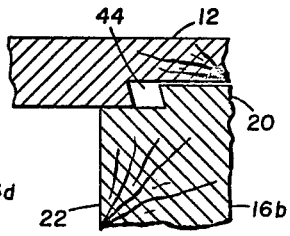
FIG 5
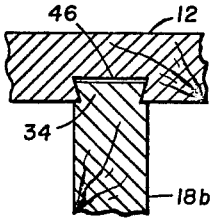
FIG 6
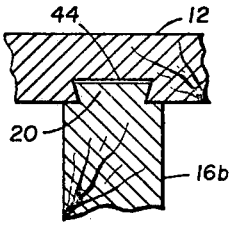
FIG 7
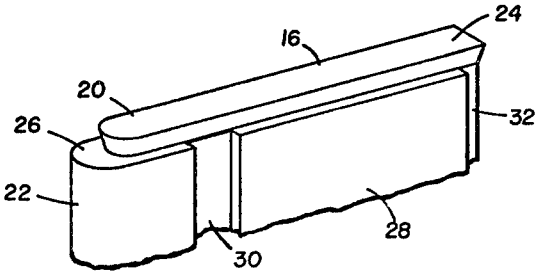
FIG 8

STAIRS AND METHOD OF MAKING THE SAME

BACKGROUND OF THE INVENTION

Wooden stairs have been used for many, many years in all types of residential construction. The standard closed stairs consist of two parallel spaced apart members, called housings or stringers, which support a sufficient number of treads and risers to span the distance between the two levels for which the stairs are designed. The conventional method of producing the components for the stairs is to use a router to machine grooves at the appropriate locations in each of the stringers. These grooves are generally tapered and they receive the treads and risers at right angles to each other to form the stairs. The tapered grooves provide for the use of wedges so that the treads and risers can be properly positioned relative to each other. Once properly positioned, each of the treads and risers is secured in place by nailing, by the use of a suitable adhesive or by using other fasteners. The most common method is to nail the treads and risers in place, and if the appearance of the stairs is important, moldings can be used to cover the nail heads. Moreover, even if the components of the stairs are premachined in a manufacturing plant, it is virtually impossible to fit the risers and treads so as to eliminate all gaps between them. Moldings can then be used to cover these gaps.

Stairs constructed using the foregoing described conventional technique can be produced and assembled in a manufacturing plant and then shipped to the job site for installation. Such stairs are obviously bulky and expensive to ship, and must be installed in the proper sequence of construction or it may become difficult to install the stairs. Moreover, the contractor must make certain that the distance to be spanned by the stairs between the two levels and the opening for the stairs are accurately measured and constructed. If not, the premanufactured stairs may be very difficult to install. To avoid these problems, it is sometimes customary for the stairs to be cut, assembled and installed on the job site. This, of course, requires more time since mass production factory techniques cannot be employed. In either event, however, it generally requires sixteen or more man hours to layout, cut the components and assemble the stairs. This time can be considerably more where more expensive decorative woods are used instead of pine or fur. Stairs, therefore, can be a relatively expensive portion of a construction project.

When using the method of construction and the resulting stairs of the invention described herein, the layout, cutting and assembly time of any stairs can be substantially reduced thus reducing the cost. Moreover, the cost of materials can be reduced because all moldings, wedges and fastening means are eliminated. The resulting stairs are much improved over conventional stairs in both appearance and construction.

SUMMARY OF THE INVENTION

First, the right and left hand stringers of the stairs are machined with a router to form a dovetail dado for each tread and riser. Then, the right and left hand edges of each tread and riser are machined to form a male dovetail, the treads being further machined to provide a radius backcut on the dovetail at the nose of each tread. Each tread is then again machined to form a dado from end to end along a line parallel with but spaced rearwardly from the nose of the tread. This dado is formed in the bottom surface of each tread, and along the rear edge of each tread a rabbet is formed. The front surface of each riser also has a dado formed in its front surface from end to end along a line parallel with the top and bottom edges of the riser and in a position where the tread will be engaging the riser. The stairs are then assembled by sliding the treads into position in the stringers with the treads moved forwardly as far as possible and beyond their final position. This is possible because of the backcut of the male dovetail on the nose end of each tread. The risers are then slid into position in their respective grooves in the stringers, but the treads are not advanced into their final positions. The first riser and tread are then interlocked, and then the second tread is moved back from its forwardmost position and locked into the dado in the first riser. This sequence is repeated for each riser and tread until the last riser is inserted and locked into the last tread. This locks the entire assembly, and when the assembled stairs are installed, it is impossible for any of the treads or risers to move from their locked position and no fasteners, adhesives or wedges are necessary to maintain the treads and risers in their proper positions.

BRIEF DESCRIPTION OF THE DRAWINGS

FIG. 1 is a front elevational view of a portion of stairs constructed according to the invention;

FIG. 2 is a sectional view of the stairs taken on the line 2—2 of FIG. 1;

FIG. 3 is a plan view of a stringer with treads and risers shown in various positions to illustrate the method of assembly;

FIGS. 4, 5, 6 and 7 are sectional views taken along the lines 4—4, 5—5, 6—6 and 7—7 of FIG. 3 respectively; and FIG. 8 is a perspective view of one end of a tread showing the male dovetail and backcut formed on each end of the tread.

DESCRIPTION OF THE PREFERRED EMBODIMENT OF THE INVENTION

FIG. 1 and FIG. 2 illustrate stairs constructed according to the principles of the invention. The stairs of the invention, like conventional stairs, have side housings or stringers 10 and 12 which extend from the floor line 14 upwardly at an angle to the next level. The stringers 10 and 12 are positioned in parallel relationship and are joined by a plurality of treads 16 and risers 18, the threads 16 being positioned horizontally while the risers 18 are vertically. The distance from the front surface of one riser perpendicularly to the front surface of the next riser 18 is the "run" and this distance is indicated by the letter "A" in FIG. 2. The full distance of a tread 16 from the face or front surface of a riser 18 to the nose 22 of the tread is referred to as the "tread", and this distance is indicated by the letter "B" in FIG. 2. The difference between the tread B and run A is the nosing. Also, as is known to those skilled in the art, the distance from the top of a tread 16 to the top of the next tread 16 is the "rise", and this distance is indicated by the letter "C" in FIG. 2.

Referring to FIG. 3, there is illustrated one of the stringers, stringer 12, in a plan view showing the inside surface of the stringer 12 with the stringer inverted from its normal position when the stairs are installed. For purposes of illustration, the treads 16 and risers 18 shown in FIG. 3 are shown in section to clarify their position in the stages of assembly. The other stringer 10 is not shown in FIG. 3. However, before describing the assembly steps, the construction of each tread 16 and each riser 18 will be described.

Referring to FIG. 8, there is shown a perspective view of a portion of one end of a tread 16. Along each end of a tread 16 there is machined a male dovetail 20 that is backcut from the nose 22 for a purpose which will be evident from the stages of assembly described hereinafter. The male dovetail 20 extends the full distance from the back edge 24 of tread 16 to the nose 22 except for the backcut portion 26. There is also machined in the bottom surface 28 of each tread 16 a dado 30 which extends the full width of the tread 16 parallel to the back edge 24. There is also machined along the back edge 24 of each tread 16 at the bottom surface 28 a rabbet 32.

Each riser 18 has machined along each end a male dovetail 34 similar to the male dovetail 20 of tread 16. However, the male dovetail 34 of each riser 18 extends the full length along each end from the top edge 36 to the bottom edge 38. There is also machined in the front surface 40 of each riser a dado 42 which dado is parallel to the top edge 36 and is spaced from the top edge a distance approximately equal to the rise C.

The inside surface of each stringer 10 and 12 is also machined with a plurality of female dovetails 44 and 46, dovetail 44 being machined to receive a tread 16 while dovetail 46 is machined to receive a riser 18. As best seen in FIG. 3, female dovetails 44 and 46 are cut starting from the lower longitudinal edge 48 toward the upper longitudinal edge 50. The length of each dovetail 44 and 46 is such to receive a tread 16 and a riser 18 in their respective final positions in the assembled stairs. The layout of the precise location of the female dovetails 44 and female dovetails 46 can be easily determined by use of a special fixture as disclosed in my co-pending U.S. Pat. application Ser. No. 876,146, filed Feb. 8, 1978, and entitled "METHOD AND APPARATUS FOR MACHINING COMPONENTS FOR STAIRS". As described in my said co-pending patent application, this fixture and the apparatus for performing the machining accurately determines the proper location and depth of the dovetails 44 and 46 regardless of the twist or warpage of the stringers 10 and 12. Of course, the shape and size of the female dovetails 44 and 46 correspond to the dimensions of the male dovetails 20 and 34 for the treads 16 and risers 18, respectively.

Referring now to FIG. 3, and also to FIGS. 4 through 7, the steps or stages of assembly of the treads 16, risers 18 and stringers 10 and 12 will be described. The stringers 10 and 12 are inverted on a flat horizontal surface with the upper edge 50 of each stringer resting on the horizontal flat surface. The stringers 10 and 12 are positioned parallel to each other and spaced apart a width corresponding to the width of the stairs when the assembly is completed. This, of course, will be the same as the width of each tread 16 and riser 18. Referring to FIG. 3, the first or top tread **16*a* is slid into its final position in the stringer 12 by sliding the male dovetail 20 into the female dovetail 44. Then, one or more treads 16*b*, 16*c*, 16*d* and 16*e* are all slid into place in a similar manner. However, treads 16*b*, 16*c*, 16*d* and 16*e* are inserted until the leading edge of the male dovetail 20 engages the end of the female dovetail 44. This is illustrated in FIG. 4. In this position, as illustrated by the position of tread 16*d* in FIG. 3, the back edge 24 of the tread is beyond the preceding female dovetail 46. The backcut 26 on each end of the tread 16 permits the tread to be moved to this advanced position and allows the risers 18 to be slid completely into female dovetails 46 near their final position. As illustrated by riser 18*c* in FIG. 3, the riser can be moved into its position by sliding the male dovetail 34 into the female dovetail 46. Each riser 18 is advanced into position until its top edge 36 is engaged in the dado 30 in the bottom surface 28 of the preceding tread 16 that has been moved to its final position. Treads 16*a* and 16*b* are in their final position, and as illustrated in FIG. 3, the top edge 36 of the risers 18*a* and 18*b* are engaged in the dados 30. When in this position, it is clear that treads 16*a* and 16*b* along with riser 18*a* are locked in position and cannot be moved. The riser 18*a* is locked in position by reason of engagement of the rabbet 32 of tread 16*b* with the dado 42 of the riser. This locking is accomplished by sliding the tread 16*b* back away from its advanced position into its final position in which the dado 30 of the tread is in alignment with the next female dovetail 46 ready to receive the top edge 36 of the next riser 18**.

The foregoing described procedure is repeated in sequence until each of the treads 16 and risers 18 have been moved to their final position interlocked with each other. Insertion of the final riser **18*e* with its top edge 36 engaged in dado 30 of tread 16*e* completes the assembly of the stairs. When the stairs are installed, the bottom edge of riser 18*e* will rest on floor line 14 thus making it impossible for any of the treads 16 or risers 18 to move. Of course, if for any reason it became necessary to disassemble the stairs, the assembly process can be reversed and each of the treads 16 and risers 18 slid out of engagement with the stringers 10 and 12**. Because of the dovetail construction, it is not necessary to use any nails or other fasteners to hold the treads and risers in place. Moreover, the construction eliminates the necessity of wedges. When the assembly is complete, there will be no gaps or spaces requiring the use of any molding. Therefore, by using the principles of the invention, material costs are reduced over the materials necessary for the conventional wooden stairs. If proper layout and machining techniques are used as described in my co-pending U.S. Pat. application Ser. No. 876,146, the assembly process can be completed in a very short period of time. I have found that using the principles of the invention a completed stairs can be constructed and assembled in approximately two man hours, whereas the conventional stairs requires almost sixteen man hours. This substantial reduction in labor greatly reduces the cost of the stairs while providing a better stairs.

Having thus described my invention, it will be obvious to those skilled in the art that various revisions and modifications can be made to the preferred embodiment described herein without departing from the spirit and scope of the invention. It is my intention, however, that all such revisions and modifications as are obvious to those skilled in the art will be included within the scope of the following claims.

I claim:

1. A construction for wooden stairs to span the distance between a lower level and an upper level, said stairs comprising longitudinally extending spaced-apart stringers extending from the lower level to the upper level, a plurality of treads extending between said stringers in longitudinally spaced-apart horizontal planes, a plurality of risers alternating with said treads and extending between said stringers in longitudinally spaced-apart vertical planes, grooves formed in each of said stringers to receive the ends of said treads and risers in their respective positions, the bottom width of each of said grooves that is formed to receive a tread being greater than the width of the groove at the surface of the stringer, and a male portion formed on each end of each tread to a cross-sectional shape corresponding to the cross-sectional shape of the corresponding grooves in said stringers so that said male portions are slidably receivable in the respective grooves of said stringers, said male portion formed on each end of each tread extends from the rear edge of the tread to a point spaced rearwardly from the front edge of said tread being at least as great as the thickness of a riser, each of said treads having a groove formed in the bottom surface thereof parallel to and spaced from the front edge of the tread so as to receive therein the top edge of a riser, and each of said risers having a groove formed in the front surface thereof parallel to and spaced from the top edge of the riser so as to receive therein the rear edge of a tread.

2. The wooden stairs construction of claim 1 in which the bottom width of each of the grooves formed to receive a riser is greater than the width of the groove at the surface of the stringer, and a male portion is formed on each end of each riser to a cross-sectional shape corresponding to the cross-sectional shape of the corresponding grooves in the stringers so that said male portions of the risers are slidably receivable in the respective grooves of said stringers.

3. The wooden stairs construction of claim 1 in which the cross-sectional shape of the grooves in said stringers are a dovetail shape, and the male portions formed on the ends of each tread are a corresponding male dovetail shape in cross-section.

4. The wooden stairs construction of claim 2 in which the cross-sectional shape of the grooves formed in said stringers to receive said risers is a female dovetail shape, and the male portion formed on the ends of each riser are a corresponding male dovetail shape in cross-section.

5. The wooden stairs construction of claims 2, 3 or 4 in which the male portions formed on each end of each tread extend from the rear edge of the tread to a point spaced rearwardly from the front edge of the tread, the distance to said point from the front edge being at least as great as the thickness of a riser.

6. The wooden stairs construction of claims 1, 2, 3 or 4 in which there is a rabbet formed along the rear edge of each tread where the rear edge joins the bottom surface of the tread, the groove formed in each riser being of a size corresponding to the rear edge of the tread remaining after the rabbet has been formed.

7. A method for constructing stairs having a pair of parallel spaced-apart stringers and alternating treads and risers positioned between said stringers, said method comprising: forming in the inside surface of each of said stringers grooves which have a greater width at the bottom than at the surface, said grooves extending from the bottom edge toward the top edge of each stringer at the plurality of locations where said treads and risers are to be located in the assembled stairs; forming a male portion on each end of each tread and riser the cross-sectional shape of which portion corresponds to the cross-sectional shape of the grooves formed in said stringers; cutting back the male portion on the ends of each tread a short distance from the nose of the tread; forming a groove in the bottom surface of each of said treads from end to end and parallel to the front and rear edges thereof at a location spaced from the nose of the tread where a riser engages the tread in the assembled stairs; forming a groove in the front surface of each of said risers from end to end and parallel to the top edge of the riser at a location spaced from the top edge where a tread engages the riser in the assembled stairs; positioning said stringers parallel to each other and spaced apart the width of the stairs when assembled; sliding a first tread into place in the uppermost grooves of said stringers until said first tread is in its final position in the assembled stairs; sliding a second tread into place in the next tread groove in each of said stringers until said tread is advanced beyond its final position in the assembled stairs; sliding a first riser into place in the riser groove of each of said stringers between said first and second treads until the top edge of said first riser is engaged in the groove in the bottom surface of said first tread thereby locking said first tread into place in its final position; moving said second tread back from its advanced position until the back edge of said tread is engaged in the groove in the front surface of said first riser; and repeating the foregoing described steps by sliding each consecutive tread into its advanced position and the next consecutive riser into locked position and moving said next tread from its advanced position into locked position until all of said treads and risers are in their final locked position thereby forming the assembled stairs.

8. The method for constructing stairs of claim 7 in which the grooves in each of said stringers are female dovetail grooves, and the male portion formed on each end of each tread and riser is a male dovetail.

9. The method for constructing stairs of claims 7 or 8 in which a rabbet is formed along the rear edge of each tread where the rear edge joins the bottom surface of the tread, and the groove formed in the front surface of each riser is of a size corresponding to the rear edge of the tread after said rabbet is formed.

* * * * *